United States Patent [19]

Copson

[11] Patent Number: 4,556,008

[45] Date of Patent: Dec. 3, 1985

[54] SEMI-SUBMERSIBLE MARINE PLATFORM

[75] Inventor: Alexander G. Copson, London, England

[73] Assignee: Adragem Limited, London, England

[21] Appl. No.: 389,248

[22] Filed: Jun. 17, 1982

[30] Foreign Application Priority Data

Jun. 22, 1981 [GB] United Kingdom ..... 8119159
Mar. 31, 1982 [GB] United Kingdom ..... 8209413

[51] Int. Cl.[4] ..... B63B 35/44
[52] U.S. Cl. ..... 114/265
[58] Field of Search ..... 114/264, 265, 266, 256

[56] References Cited

U.S. PATENT DOCUMENTS

| | | | |
|---|---|---|---|
| 2,525,955 | 10/1950 | Scott . | |
| 2,678,017 | 5/1954 | Collins . | |
| 2,938,352 | 5/1960 | Knapp et al. . | |
| 3,099,912 | 8/1963 | Wolff . | |
| 3,150,628 | 9/1964 | Brinkmann, Jr. et al. . | |
| 3,154,039 | 10/1964 | Knapp | 114/265 |
| 3,163,147 | 12/1964 | Collipp . | |
| 3,181,272 | 5/1965 | Gibson . | |
| 3,224,401 | 12/1965 | Kobus . | |
| 3,246,476 | 4/1966 | Wolff . | |
| 3,273,526 | 9/1966 | Glosten . | |
| 3,294,051 | 12/1966 | Khelstovsky . | |
| 3,355,899 | 12/1967 | Koonce | 114/265 |
| 3,420,066 | 1/1969 | Bishop . | |
| 3,443,543 | 5/1969 | Willm et al. . | |
| 3,444,693 | 5/1969 | Busey | 114/264 |
| 3,502,239 | 4/1970 | Wipkink et al. . | |
| 3,568,620 | 3/1971 | Douglas . | |
| 3,605,669 | 9/1971 | Yu . | |
| 3,610,193 | 10/1971 | Lacy et al. . | |
| 3,712,068 | 1/1973 | Liautaud | 114/264 |
| 3,830,176 | 8/1974 | Arita et al. . | |
| 3,837,309 | 9/1974 | Biewer | 114/265 |
| 3,880,102 | 4/1975 | Biewer | 114/256 |
| 3,885,511 | 5/1975 | Wipkink et al. . | |
| 3,996,755 | 12/1976 | Kalinowski . | |
| 4,080,795 | 3/1978 | Weidler, Jr. | 114/264 |
| 4,167,148 | 9/1979 | Fayren . | |

FOREIGN PATENT DOCUMENTS

| | | |
|---|---|---|
| 1150509 | 4/1969 | United Kingdom . |
| 1371846 | 10/1974 | United Kingdom . |
| 1387369 | 3/1975 | United Kingdom . |
| 1462401 | 1/1977 | United Kingdom . |
| 1495833 | 12/1977 | United Kingdom . |
| 1501288 | 2/1978 | United Kingdom . |

OTHER PUBLICATIONS

*Oil and Gas Journal*—Aug. 23, 1971, "New Semi-Submersible-Rig Design Improves Stability".

*Offshore Technology Conference,* Paper No. 1419, Apr. 1971—"The Articulated Column Semi-Submersible Stable Ocean Platform".

Undated Paper by Offshore Technology Corp., "Stable Ocean Platform", (believed to have been made publically available in 1971).

*Primary Examiner*—Trygve M. Blix
*Assistant Examiner*—Stephen P. Avila
*Attorney, Agent, or Firm*—John J. Byrne; Bradford E. Kile; Kevin M. O'Brien

[57] ABSTRACT

This invention concerns a semi-submersible marine platform comprising an above water deck, a support structure extending downwardly from the deck into the water and supporting the deck on pods providing buoyancy for the platform, and stabilizer legs spaced around the support structure and outrigged underwater thereby or therefrom, each stabilizer leg preferably being free to pivot under environmental forces about an underwater universal pivot and extending upwardly therefrom to project substantially above mean water level and provide a cut water plane area for imparting a righting moment against environmental forces acting on the platform.

4 Claims, 2 Drawing Figures

SEMI-SUBMERSIBLE MARINE PLATFORM

Figure 1:
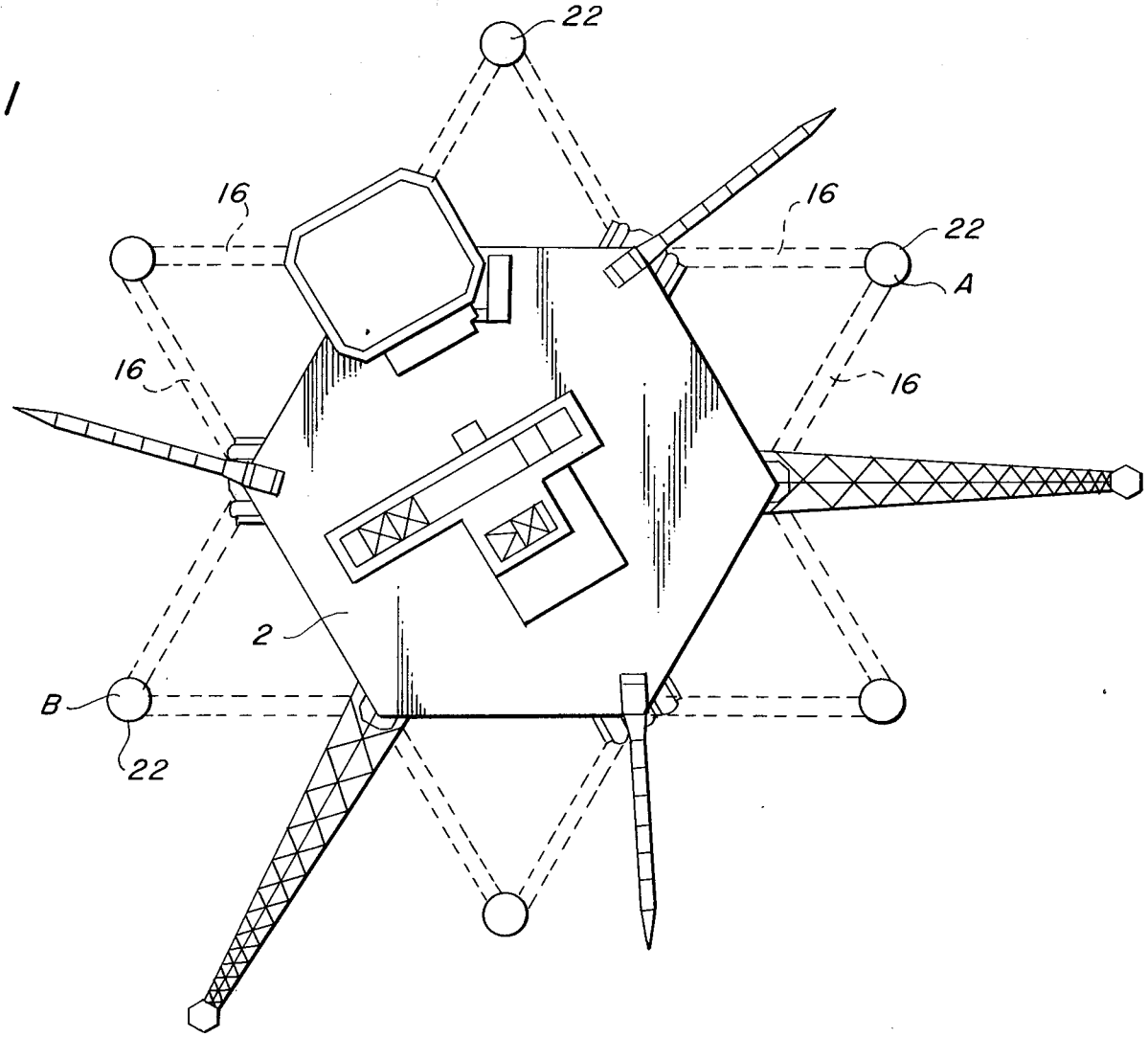

The present invention concerns a semi-submersible marine platform comprising an above water deck, a support structure extending downwardly from the deck into the water and supporting the deck on means providing buoyancy for the platform, and stabiliser legs spaced around the support structure and outrigged underwater thereby or therefrom, each stabiliser leg preferably being free to pivot under environmental forces about underwater universal pivot means and extending upwardly therefrom to project substantially above mean water level and provide a cut water plane area for imparting a righting moment against environmental forces acting on the platform.

According to the invention, it is especially desirable that such a platform should have any one or more, preferably at least two or three, and most preferably all, of the following features (a), (b), (c) and (d):

(a) the support structure is a space frame;

(b) at least a majority of the buoyancy for the platform is provided by upright buoyancy pods or pod portions fixed relative to the deck. This gives a higher centre of buoyancy than use of the conventional arrangement of horizontal buoyancy pods, and so increases the stability of the platform. The upright pods are preferably part of a space frame constituting the support structure or are combined in such a space frame; they may for example be upright tubular pods of increased diameter extending from the base of or surrounding the lower portion of respective vertical legs of the space frame. The metacentric height of the platform will generally be at least 4 meters, e.g. about 6 meters or more, and can be about 11 meters;

(c) the buoyancy means is disposed inboard of the perimeter defined by the stabiliser legs, thus reducing the overall pitching moment on the platform. Preferably the buoyancy means (e.g. buoyancy pods) is disposed at or within the greatest perimeter of the deck. The buoyancy means is preferably incorporated in or attached to a space frame constituting the support structure. Preferably, the buoyancy pods or other buoyancy means will be directly below the deck and attached thereto by vertical members of such a space frame. The buoyancy means preferably comprises pods or pod portions as in feature (b) above. With this feature (c), the stabiliser legs could contribute some positive buoyancy to the platform, but there is preferably substantial separation of buoyancy from cut water plane area as at (d) below;

(d) the positive buoyancy of the platform is substantially separate from the cut water plane area, which is provided mainly (preferably substantially wholly) by the stabiliser legs; in other words, the stabiliser legs contribute little or no buoyancy to the platform as a whole; this feature is preferably present along with at least one of features (a), (b) and (c). The stabiliser legs preferably contribute no more than 15% of the buoyancy of the platform, e.g. about 10%.

In general, at least the main buoyancy for the platform according to the invention is disposed so as to remain in use below water level, out of the main wave zone, in all conditions. The deck is preferably hexagonal, with a space frame supporting it at each apex from the underwater buoyancy means.

It is preferred to design the stabiliser legs to have a natural period of at least 20 seconds, preferably at least 25 seconds, e.g. about 30 seconds, to avoid frequency ranges of large wave energy and minimise horizontal forces at the pivot, and to help in achieving the required advantageous response to wave action. To achieve the required natural periods at least a portion of the lower, underwater, length of each leg may for example be surrounded by a jacket which can be water filled and open to the external water or which can if desired be designed to provide for oil storage. Fins may be secured at the lower end of the stabiliser leg or its jacket to increase drag and damping, which may also be improved by extending the jacket wall upwards and providing it with openings. The required response to wave motion and hence provision of righting moment for the platform may also be improved by weighting the exposed top ends of the stabiliser legs thus increasing the moment of inertia and natural period. Whilst reference has been made to the use of a water-filled jacket to provide added mass to the lower portion of a stabiliser leg, other means for providing such added mass are of course possible. Some or all of the necessary damping could be provided by dash pots or the like. By the means mentioned it is possible to provide stabiliser legs of a natural period and extent of angular pivot to impart righting moment to maintain the platform steady in storm conditions.

In one embodiment of the platform according to the invention the deck is of regular hexagonal shape and an upright columnar buoyancy pod is disposed directly under each apex of the hexagon and connected to that apex by a vertical member of the space frame. The buoyancy pods, which also contain nodes for the members of the space frame, are themselves interconnected by horizontal base members of the space frame. Forming triangles with the horizontal members joining adjacent buoyancy pods are further horizontal frame members extending outwardly to a node on which is mounted a universal pivot for an upwardly extending stabiliser leg; there are thus six such outrigged nodes, each with its universally pivoted stabiliser leg, and these outrigged nodes are connected to the upright members of the space frame by inclined frame members. Each stabiliser leg extends outwardly above water level in storm conditions, e.g. to deck level or a little below. These legs may be surrounded from their bases to about 10 meters below mean water level with a jacket whose interior is open to the external water.

An important aspect of platforms according to the invention is that any one of the stabiliser legs may act as a mooring and/or oil offtake point for a tanker.

Figure 2:
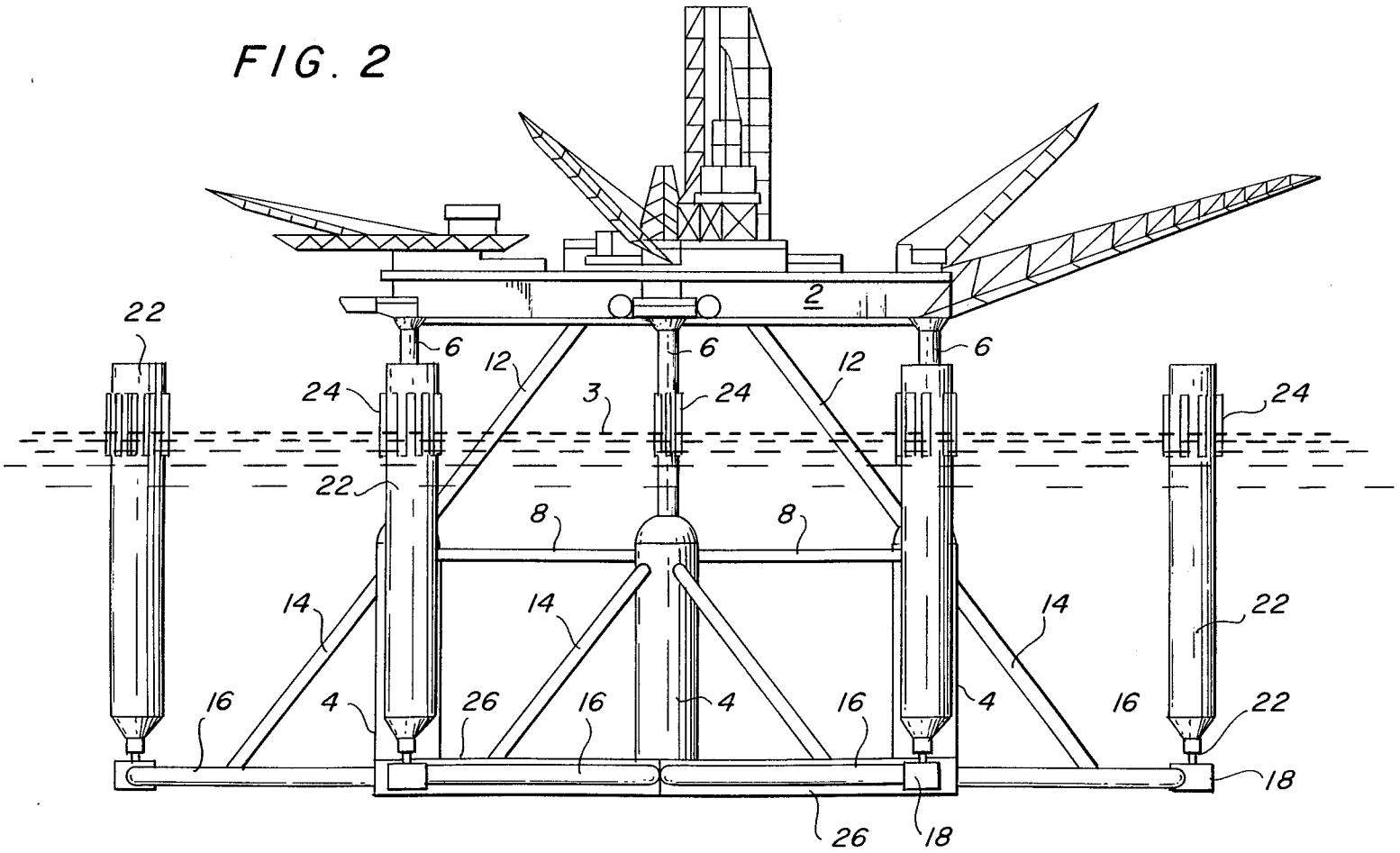

One embodiment of a platform according to the invention is illustrated, by way of example only, by FIG. 1 (plan view) and FIG. 2 (elevation view) of the accompanying drawings.

The illustrated platform has a regular hexagonal deck 2 carrying deck superstructure and equipment of the type conventional for marine oil and gas drilling and/or production. The deck 2 is supported above mean water level 3 by a space frame incorporating vertically disposed buoyancy pods 4. One such buoyancy pod is disposed directly below each apex of the hexagonal deck and is connected to that apex by a vertical tubular member 6 of the space frame, the buoyancy pods being themselves interconnected by horizontal tubular members 8 of the space frame. Included in the space frame are pairs of horizontal tubular members 16 (each such pair defining a triangle with a line joining the bases of adjacent pods 4), and inclined tubular members 12 and 14—the former connecting pods 4 to the deck 2 and the latter connecting the pods 4 to the outrigger horizontal tubular members 16. The buoyancy pods 4 contain nodes for the various tubular members of the space frame. The pairs of horizontal outrigger space frame members 16 meet at respective nodes 18, each node 18 having preferably mounted thereon a universal pivot 20 for an upwardly extending hollow stabiliser leg 22. At the normal water level 3, the legs 22 and vertical space frame members 6 may be surrounded with fenders 24. Legs 22 are shown terminating below deck level, but could for example extend upwardly to about mid-deck level.

Means are provided for ballasting and deballasting the legs 22 and the buoyancy pods 4, which will usually be compartmentalised to facilitate buoyancy control. The vertical space frame members 6 may terminate within the tops of the buoyancy pods 4, or may continue down to their bases. For operational use, the stabiliser legs 22 will preferably be partially ballasted so as to be of low or zero buoyancy in calm water, contributing only a minor amount (e.g. about 10%) to the buoyancy of the platform.

In one platform as illustrated, the distance between the axes of directly opposed legs 22 (e.g. A and B in FIG. 1) is about 150 meters, the tops of pods 4 are about 12 meters below mean water level 3, the legs 22 are of about 8 or 9 meters diameter, veritcal space frame members 6 are of about 2.5 meters diameter, inclined space frame members 12 and 14 are of about 2.5 and 1.5 meters diameter respectively, horizontal outrigger space frame members 16 are of about 2.5 meters diameter, horizontal space frame members 8 are of about 1.5 meters diameter, pods 4 are of about 8.2 meters diameter, and the bases of pods 4 are about 50 meters below mean water level 3. For such a platform of a total displacement of about 45,000 tons, each leg 22 could for example provide about 700 tons worth of buoyancy.

Platforms according to the invention can support a much greater deck weight for a given amount of platform support structure than semi-submersible platforms currently available.

Improved motion responses of the rig are attributable to the following design features:

1. Improved heave and pitch response due to deep immersion of main buoyancy elements.

2. Improved surge response as horizontal wave energy is not appreciably absorbed by the main structure and cancellation or counterbalancing occurs between the motions of the articulated stabiliser legs. The wide spacing of the stabiliser legs 22 is advantageous for stability.

The configuration proposed enables direct attachment of a tanker to one of the articulated stabiliser legs for oil offtake. This is possible as relative motions of the tanker and semi-sub are absorbed by the articulation and the resulting reaction forces are not fully transmitted to the rig. The rig motion characteristics are not adversely affected by the attachment of the tanker.

In the embodiment illustrated the vertical pods 4 stand on the apices of a base hexagon formed by six horizontal tubular (preferably box section) space frame members 26 e.g. of about 3 m deep×5 m wide cross section. The horizontal base members 16 and 26 of the space frame can both be of box section, and will usually be ballasted in operation to contribute little or no buoyancy to the platform.

A platform according to the invention is suitably assembled by first assembling the upright buoyancy pods and connecting horizontal space frame members, followed by installation of the horizontal outrigger space frame members and inclined bracing space frame members (14) therefor. This may be accomplished in a dry dock or on a building berth with skidded launching. The resulting partial structure, when floated, can then have the vertical space frame members 6 installed, using a floating crane, and the resulting partial assembly can then be ballasted to leave just the tops of the vertical space frame members above water (possibly with temporary buoyancy attached), followed by mating of the deck with the vertical space framce members whilst the deck is supported on barges. In an alternative to the latter procedure, the deck with the vertical space frame members upstanding therefrom, floated on barges, may be mated with the ballasted hull and vertical pods, followed by jacking up of the deck. The deck could itself be buoyant, in which case in either procedure it could be floated to position without supporting barges. The stabiliser legs may then be floated to site, ballasted for immersion, and mounted on the respective outrigged universal joints 20 on outrigged nodes 18.

Whilst there has been described and illustrated a platform having a hexagonal configuration, it will be appreciated that other deck shapes, with other numbers of vertical space frame members and buoyancy pods, are of course possible.

What I claim is:

1. A semi-submersible marine platform operable to be floatingly stationed upon and partially submerged within a body of water with enhanced payload capacity and stability, said semi-submersible platform comprising:

a platform deck generally horizontally extending above the surface of the body of water;

support means for maintaining said platform deck above the surface of the body of water and extending downwardly from the deck and into the body of water, said support means including, platform legs extending generally vertically downwardly from said deck wherein central longitudinal axes of said plurality of platform legs are mutually parallel and substantially within a vertically extended perimeter of said platform deck, buoyancy means associated with each of said platform legs for buoyantly supporting said semi-submersible marine platform from beneath said platform deck substantially within a vertically extended perimeter of said platform deck, said platform legs being cylindrical structural members and said buoyancy means each comprise a generally cylindrical buoyancy pod positioned at distal ends of each of said platform legs and having a diameter substantially greater than the diameter of said platform legs, said buoyancy pods each coaxially surround a distal end of a respective one of said platform legs, and an uppermost portion of each of said buoyancy means being spaced from a lowermost portion of said platform deck, said uppermost portion operably extends substantially beneath the surface of the body of water when the semi-submersible marine platform is on station and in a working posture such that said buoyancy means is substantially beneath horizontal wave energy of the body of water in a working mode of the semi-submersible marine platform;

frame members structurally interconnecting said plurality of platform legs and buoyancy means; and stabilizer legs symmetrically disposed about said platform for stabilizing said semi-submersible marine platform, each of said stabilizer legs extending in a substantially vertical posture outside of the vertically extended periphery of said deck, said stabilizer legs each having a first portion extending within the body of water and a second portion extending above the surface of the body of water for providing a stabilizing cut water plane area for the platform outside the vertically extended periphery of the deck, said first portions being pivotally connected to generally horizontal extensions of said frame means such that said stabilizer legs may operably pivot in response to environmental forces, said stabilizer legs contributing no more than fifteen percent of the total buoyancy of the platform wherein platform buoyancy is provided substantially within the periphery of said deck by said buoyancy means positioned beneath said deck substantially independent of said buoyant stabilizer legs.

2. A semi-submersible marine platform as defined in claim 1 wherein:

said stabilizer legs are essentially neutrally buoyant and do not contribute to the total buoyancy of the platform.

3. A semi-submersible marine platform as defined in claim 1 wherein:

said buoyancy means are uniformly spaced about, lie beneath, and act vertically beneath the perimeter of said platform deck.

4. A semi-submersible marine platform as defined in claims 1 or 2 wherein:

said platform legs are cylindrical and said buoyancy means each comprises a generally cylindrical buoyancy pod positioned at distal ends of each of said platform legs and having a diameter substantially greater than the diameter of said platform legs.

* * * * *